US007044863B1

(12) United States Patent
Brewster

(10) Patent No.: US 7,044,863 B1
(45) Date of Patent: May 16, 2006

(54) GRIP ADJUSTING INSERT FOR A HOLE IN A BOWLING BALL

(76) Inventor: Frederick A. Brewster, 41 Maddison Ave., Amityville, NY (US) 11701

( * ) Notice: Subject to any disclaimer, the term of this patent is extended or adjusted under 35 U.S.C. 154(b) by 0 days.

(21) Appl. No.: 10/244,279

(22) Filed: Sep. 16, 2002

(51) Int. Cl.
*A63B 37/00* (2006.01)

(52) U.S. Cl. ..... 473/129; 473/130

(58) Field of Classification Search ..... 473/128, 473/129, 130; 403/348, 349
See application file for complete search history.

(56) References Cited

U.S. PATENT DOCUMENTS 3,102,725 A * 9/1963 Jarus ..... 473/130
3,416,796 A 12/1968 Ginder
4,247,102 A 1/1981 Seyler
4,560,162 A 12/1985 Miller
4,561,654 A * 12/1985 Haza ..... 473/129
4,892,308 A * 1/1990 Gaunt ..... 473/129
5,118,106 A * 6/1992 Goldman ..... 473/129
5,186,197 A * 2/1993 Lavine ..... 135/25.4
5,308,061 A 5/1994 Bernhardt
5,738,592 A * 4/1998 Saunders ..... 473/130
5,741,084 A * 4/1998 Del Rio et al. ..... 403/349
5,800,276 A 9/1998 Hill
6,003,724 A * 12/1999 Collins et al. ..... 221/154

* cited by examiner

*Primary Examiner*—William M. Pierce
(74) *Attorney, Agent, or Firm*—Richard L. Miller

(57) ABSTRACT

A grip adjusting insert for a hole in a bowling ball. An outer sleeve is inserted in the hole in the bowling ball, an inner sleeve is movably mounted in the sleeve, and a finger-engaging member is affixed in the inner sleeve and conforms to a finger of a user. The outer sleeve has a pair of throughslots that are inverted T-shaped. The inner sleeve has a pair of pins that ride axially downwardly in the pair of throughslots in the outer sleeve, respectively, when the inner sleeve is inserted into the sleeve, and at which time, the inner sleeve is rotated relative to the outer sleeve so as to cause the pair of pins to move laterally in the pair of throughslots in the outer sleeve, respectively. The finger-engaging member is rubber poured into the inner sleeve, with a finger therein so as to conform thereto.

3 Claims, 1 Drawing Sheet

GRIP ADJUSTING INSERT FOR A HOLE IN A BOWLING BALL

BACKGROUND OF THE INVENTION

1. Field of the Invention

The present invention relates to a grip adjusting insert. More particularly, the present invention relates to a grip adjusting insert for a hole in a bowling ball.

2. Description of the Prior Art

Numerous innovations for bowling ball inserts have been provided in the prior art that will be described. Even though these innovations may be suitable for the specific individual purposes to which they address, however, they differ from the present invention.

A FIRST EXAMPLE, U.S. Pat. No. 3,416,796 to Ginder teaches a cylindrical longitudinally-slotted finger-receiving insert that is axially movable within a cylindrical sleeve secured in a bowling ball. When moved axially by a securing bolt passing through a closure member at one end of the insert and into the ball, tapered walls of the insert and sleeve coact to charge the inner diameter of the insert without changing the angular relationship between the insert and its longitudinal axis. When the insert is removed from the ball, an enlargement in the insert slot permits the bolt to be slide into and out of a slot in the closure member communicating with the insert slot.

A SECOND EXAMPLE, U.S. Pat. No. 4,247,102 to Seyley teaches a removable interchangeable thumb or finger grip insert for the thumb or finger hole of a bowling ball. The insert is generally cylindrical and hollow and is formed with a slotted resilient hollow bottom axial internally and externally threaded stud for threadedly engaging in the bottom of the bowling ball hole. A tapered adjustable wedging screw is engaged in the hollow stud for expanding it to tightly grip the bowling ball. The screw has a square bore engageable by a correspondingly shaped L-shaped square tool bar. A spanner wrench tool is provided, the bottom of the wrench tool having a pair of spaced depending pins engageable in holes provided in the bottom of the insert for rotating same.

A THIRD EXAMPLE, U.S. Pat. No. 4,560,162 to Miller teaches a device mountable within the thumb opening or thumb hole of a bowling ball which is manually adjustable to constrict the opening i.e., narrow the diameter of the opening of the thumb hole. A screw is threaded directly against a movable shoulder which narrows the opening for the thumb. Unscrewing or reversal of the screw causes the shoulder to move outwardly toward its original position to enlarge the opening for the thumb. The screw includes a bottom lip to prevent it from being totally unscrewed and the possible risk of loss. In a second embodiment, a screw serves as a cam rotator to move a cam on an eccentric toward the movable shoulder thereby forcing the shoulder to move inwardly and thus constrict the thumb opening.

A FOURTH EXAMPLE, U.S. Pat. No. 4,561,654 to Haza teaches an insert for varying the inside diameter of a hole in a device such as a bowling ball. The insert has a co-axial pair of telescoping tubes joined by a thread so that the tubes may be made longer or shorter by turning one of said tubes relative to another of the tubes. The inside tube terminates at its upper end in a conical wedge shape. A flexible tube or sleeve is cemented to the outside telescoping tube to be engaged by the inside tube as it telescopes. The flexible tube has a conical wedge on its outside surface for confronting the conical wedge shaped end of the inside tube. By turning one of the tubes, the two conical wedges advance toward or retract from each other to construct or relax the diameter of the flexible tube over a continuous range extending from a fully relaxed maximum diameter hole to a fully constricted minimum diameter hole.

A FIFTH EXAMPLE, U.S. Pat. No. 4,892,308 to Gaunt teaches a bowling ball that has an oversized finger hole in which a rigid liner insert is secured. The rigid liner insert has an inner cylindrical bore with an internal threaded portion. A cylindrical finger receiving insert has an internal bore of a preselected diameter and an external cylindrical surface with external threads formed thereon. The finger receiving insert having an internal bore of a preselected diameter is threadedly secured in the liner insert to provide a bowling ball having a finger hole of a preselected diameter. The finger receiving insert may be threadably removed from the liner insert and another finger receiving insert with a different preselected diameter may be threadedly secured therein.

A SIXTH EXAMPLE, U.S. Pat. No. 5,308,061 to Bernhardt teaches a finger hole insert for a bowling ball which is formed of a resilient tubular body and is adapted to be inserted into a finger hole. The insert has an oblong cylindrical inner wall surface defining finger openings at opposite terminal ends of the insert which are sized to permit insertion of a bowler's finger therein. The finger openings have thickened parallel planar finger pads therein adapted for cushioning the bowler's finger. The finger openings also have opposed arcuate finger pads for augmenting the spin and lift applied during delivery of the bowling ball. In this matter, the bowler has a preferential choice between the two functions provided by each finger opening of the insert.

A SEVENTH EXAMPLE, U.S. Pat. No. 5,800,276 to Hill teaches an insert system for the finger and thumb holes of a bowling ball and a method for installing the insert system. The insert system includes a master that is bonded inside each of the holes. A number of inserts are provided having different internal diameters, shapes, and pitches (the angle of the hole relative to the ball's surface). Inserts are also provided that have offset internal holes, to allow for changes in finger span by rotating the insert relative to the master. The master is provided with tapered inner and outer surfaces. The taper on the outer surface helps in bonding the master to the ball by providing voids that are filled with adhesive. The tapered inner surface cooperates with a tapered outer surface on the insert, to lock the insert to the master. A round head screw assembly is additionally provided with each insert to insure that a shock of impact will not loosen the fit between the master and the insert.

It is apparent that numerous innovations for bowling ball inserts have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a grip adjusting insert for a hole in a bowling ball that avoids the disadvantages of the prior art.

ANOTHER OBJECT of the present invention is to provide a grip adjusting insert for a hole in a bowling ball that is simple and inexpensive to manufacture.

STILL ANOTHER OBJECT of the present invention is to provide a grip adjusting insert for a hole in a bowling ball that is simple to use.

BRIEFLY STATED, STILL YET ANOTHER OBJECT of the present invention is to provide a grip adjusting insert for a hole in a bowling ball. An outer sleeve is inserted in the hole in the bowling ball, an inner sleeve is movably mounted in the sleeve, and a finger-engaging member is affixed in the inner sleeve and conforms to a finger of a user. The outer sleeve has a pair of throughslots that are inverted T-shaped. The inner sleeve has a pair of pins that ride axially downwardly in the pair of throughslots in the outer sleeve, respectively, when the inner sleeve is inserted into the sleeve, and at which time, the inner sleeve is rotated relative to the outer sleeve so as to cause the pair of pins to move laterally in the pair of throughslots in the outer sleeve, respectively. The finger-engaging member is rubber poured into the inner sleeve, with a finger therein so as to conform thereto.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 2:
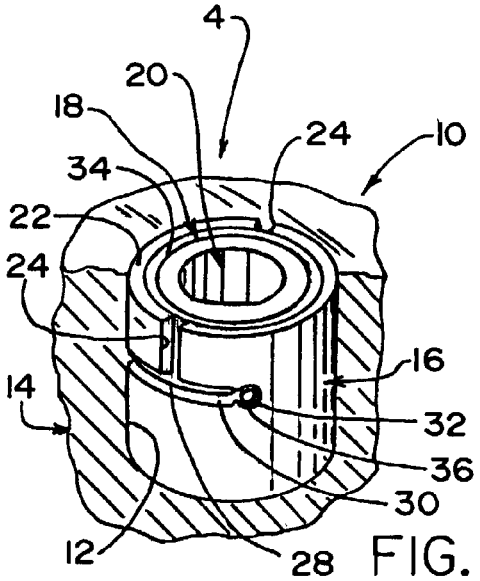
FIG. 2 is an enlarged diagrammatic perspective view of the area generally enclosed by the dotted curve identified by arrow 2 in FIG. 1 of the present invention.

10 grip adjusting insert of present invention for hole 12 in bowling ball 14

12 hole in bowling ball 14

14 bowling ball

15 outer contour of bowling ball 14

16 outer sleeve for inserting in hole 12 in bowling ball 14

18 inner sleeve

20 finger-engaging member for conforming to finger of user

22 uppermost surface of outer sleeve 16 for matching outer contour 15 of bowling ball 14

24 pair of throughslots in outer sleeve 16

26 first portion of each throughslot of pair of throughslots 24 in outer sleeve 16

28 terminal end of first portion 26 of each throughslot of pair of throughslots 24 in outer sleeve 16

30 second portion of each throughslot of pair of throughslots 24 in outer sleeve 16

32 pair of terminal ends of second portion 30 of each throughslot of pair of throughslots 24 in outer sleeve 16

34 uppermost surface of inner sleeve 18 for matching outer contour 15 of bowling ball 14

36 pair of pins of inner sleeve 18

DETAILED DESCRIPTION OF THE PREFERRED EMBODIMENT

Figure 1:
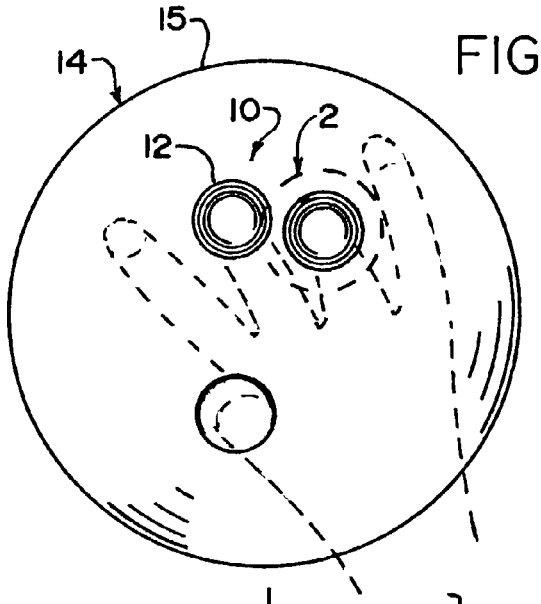
FIG. 1 is a diagrammatic perspective view of the present invention in use.
Figure 6:
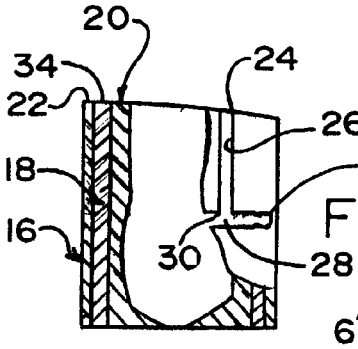
FIG. 6 is a diagrammatic cross sectional view taken along line 6—6 in FIG. 4.
Figure 4:
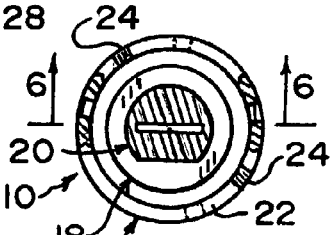
FIG. 4 is a diagrammatic top plan view taken generally in the direction of arrow 4 in FIG. 2.
Figure 3:
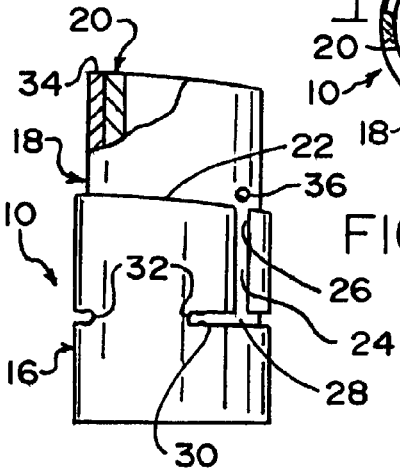
FIG. 3 is a partially exploded diagrammatic perspective view of the present invention shown in FIG. 2.
Figure 5:
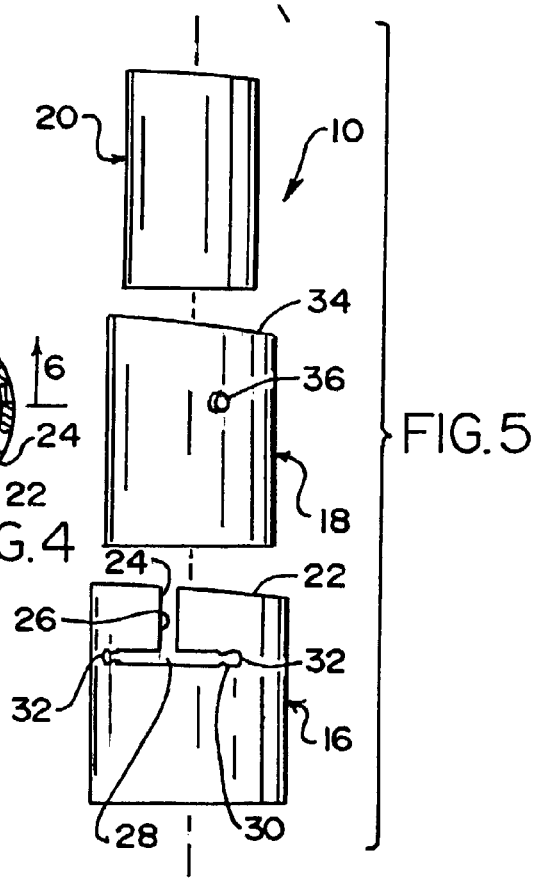
FIG. 5 is an exploded diagrammatic side elevational view of the present invention shown in FIG. 2.

Referring now to the figures, in which like numerals indicate like parts, and particularly to FIG. 1, the grip adjusting insert of the present invention is shown generally at 10 for a hole 12 in a bowling ball 14, wherein the bowling ball 14 has an outer contour 15.

The configuration of the grip adjusting insert 10 can best be seen in FIGS. 2–6, and as such, will be discussed with reference thereto.

The grip adjusting insert 10 comprises an outer sleeve 16 and an inner sleeve 18. The outer sleeve 16 is for inserting in the hole 12 in the bowling ball 14 and the inner sleeve 18 is movably mounted in the sleeve 16.

The grip adjusting insert 10 further comprises a finger-engaging member 20. The finger-engaging member 20 is affixed in the inner sleeve 18 and is for conforming to a finger of a user.

The outer sleeve 16 has an uppermost surface 22. The uppermost surface 22 of the outer sleeve 16 is arched for matching the outer contour 15 of the bowling ball 14.

The outer sleeve 16 further has a pair of throughslots 24. The pair of throughslots 24 in the outer sleeve 16 are almost diametrically opposed to each other.

Each throughslot 24 in the outer sleeve 16 is inverted T-shaped, and as a result thereof, has a first portion 26 that depends axially from, and opens into, the uppermost surface 22 of the outer sleeve 16, to approximately midway of the outer sleeve 16, to a terminal end 28, and a second portion 30 that extends transversely across, and equidistantly from, the terminal end 28 of the first portion 26, to a pair of terminal ends 32. The pair of terminal ends 32 of the second portion 30 are pinched.

The inner sleeve 18 has an uppermost surface 34. The uppermost surface 34 of the inner sleeve 18 is arched for matching the outer contour 15 of the bowling ball 14.

The inner sleeve 18 further has a pair of pins 36. The pair of pins 36 extend radially outwardly from the inner sleeve 18 and are almost diametrically opposed to each other so as to match positioning of the pair of throughslots 24 in the outer sleeve 16 and allow only one way insertion of the inner sleeve 18 into the outer sleeve 16.

The pair of pins 36 of the inner sleeve 18 ride downwardly in the first portions 26 of the pair of throughslots 24 in the outer sleeve 16, respectively, until reaching the terminal ends 28 of the first portions 26 of the pair of throughslots 24 in the outer sleeve 16, respectively, when the inner sleeve 18 is inserted into the sleeve 16, and at which time, the inner sleeve 18 is rotated relative to the outer sleeve 16 so as to cause the pair of pins 36 to ride across in the second portions 30 of the pair of throughslots 24 in the outer sleeve 16, respectively, until reaching the pair of terminal ends 32 of the second portion 30, respectively, where they are captured by virtue of the pair of terminal ends 32 being pinched.

The finger-engaging member 20 is rubber poured into the inner sleeve 18, with the finger therein so as to conform thereto.

It will be understood that each of the elements described above, or two or more together, may also find a useful application in other types of constructions differing from the types described above.

While the invention has been illustrated and described as embodied in a grip adjusting insert for a hole in a bowling ball, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A grip adjusting insert for a hole in a bowling ball, wherein the bowling ball has an outer contour, said insert comprising:

a) an outer sleeve; and b) an inner sleeve;

wherein said outer sleeve is for inserting in the hole in the bowling ball; and wherein said inner sleeve is movably mounted in said outer sleeve;

wherein said outer sleeve has an uppermost surface;

wherein said uppermost surface of said outer sleeve is arched for matching the outer contour of the bowling ball;

wherein said outer sleeve has a pair of throughslots;

wherein said pair of throughslots in said outer sleeve are almost diametrically opposed to each other;

wherein each throughslot in said outer sleeve is inverted T-shaped;

wherein each throughslot in said outer sleeve has a first portion;

wherein said first portion depends axially from said uppermost surface of said outer sleeve, to approximately midway of said outer sleeve, to a terminal end;

wherein said first portion opens into said uppermost surface of said outer sleeve;

wherein each throughslot in said outer sleeve has a second portion;

wherein said second portion extends transversely across said terminal end of said first portion, to a pair of terminal ends;

wherein said second portion extends equidistantly from said terminal end of said first portion;

wherein said pair of terminal ends of said second portion are pinched;

wherein said inner sleeve has a pair of pins;

wherein said pair of pins extend radially outwardly from said inner sleeve; and wherein said pair of pins are almost diametrically opposed to each other so as to match positioning of said pair of throughslots in said outer sleeve and allow only one way insertion of said inner sleeve into said outer sleeve.

2. The insert as defined in claim 1; further comprising a finger-engaging member;

wherein said finger-engaging member is affixed in said inner sleeve; and wherein said finger-engaging member is for conforming to a finger of a user.

3. The insert as defined in claim 2, wherein said finger-engaging member is rubber poured into said inner sleeve, with a finger therein so as to conform thereto.

* * * * *